US006199230B1

(12) United States Patent
Parikh

(10) Patent No.: US 6,199,230 B1
(45) Date of Patent: Mar. 13, 2001

(54) CHILDREN'S FOLDABLE PORTABLE INDOOR/OUTDOOR PLAY MAT/CORRAL

(75) Inventor: Christina M. Parikh, 1291 Shell Cir., Clayton, CA (US) 94517

(73) Assignee: Christina M. Parikh, Clayton, CA (US)

( * ) Notice: Subject to any disclaimer, the term of this patent is extended or adjusted under 35 U.S.C. 154(b) by 0 days.

(21) Appl. No.: 09/129,520

(22) Filed: Aug. 5, 1998

Related U.S. Application Data

(60) Provisional application No. 60/055,249, filed on Aug. 11, 1997.

(51) Int. Cl.[7] ..... A47G 9/06
(52) U.S. Cl. ..... 5/420; 5/655; 5/732
(58) Field of Search ..... 5/420, 655, 732, 5/424, 425

(56) References Cited

U.S. PATENT DOCUMENTS

| | | | | |
|---|---|---|---|---|
| D. 359,869 | * | 7/1995 | Oren | 5/655 X |
| 3,363,272 | * | 1/1968 | Channon . | |
| 4,873,734 | * | 10/1989 | Pollard | 5/425 X |
| 4,999,863 | * | 3/1991 | Kane | 5/420 X |
| 5,035,013 | | 7/1991 | Bloom . | |
| 6,026,525 | * | 2/2000 | Davis | 5/99.1 |

* cited by examiner

*Primary Examiner*—Terry Lee Melius
*Assistant Examiner*—James M Hewitt
(74) *Attorney, Agent, or Firm*—Mark A. Haynes

(57) ABSTRACT

The Infant/toddler indoor—outdoor play/mat corral with locking handle 16 and clasp mechanism 18 has a top quilt base 10 and foam block walls 40 which follow the perimeter of the base. Fabric 14 is sewn together creating two "U" shape receiving channels which overlay foam block walls 40 and are sewn to top quilt base 10 and bottom water resistant base 28 from interior to exterior. A locking handle 16 and clasp mechanism 18 including a handle piece sewn into one exterior wall that is fitted into a clasp sewn into the opposite exterior wall forming a handle for securing and carrying purposes. When the corral is folded along its diameter 30 creating a single "U" shape, the foam block walls 40 collapse and meet by connecting VELCRO strips 32 sewn along the bottom water resistant base 28 thus keeping the wall portions secure with the locking handle 16 and clasp mechanism 18. A pocket 22 is sewn to exterior wall portion to store items when folded and unfolded. Two zippers 20 sewn into the longest exterior wall portion have been provided for easy removal and insertion of foam block walls 40 for washing purposes. Water resistant fabric has been selected for indoor and outdoor use. Cylindrical cutouts 24 located along the top surface portion have been created to accommodate bottle/cups. Further, in its alternative embodiment a flex bar 26 with removable toys 36 may be snapped into cylindrical cutouts 24 as entertainment for a child when unfolded and used as a shoulder harness when folded.

12 Claims, 10 Drawing Sheets

CHILDREN'S FOLDABLE PORTABLE INDOOR/OUTDOOR PLAY MAT/CORRAL

CROSS REFERENCES TO RELATED APPLICATIONS

This application claims the benefit of Provisional patent application Ser. No. 60/055,249, filed Aug. 11, 1997.

BACKGROUND

1. Field of Invention

This invention relates to children's play and activity mats, specifically to an improved type of mat that is machine washable and includes a locking handle and clasp mechanism that can be used for securing and carrying purposes.

2. Description of Prior Art

Toy and department stores commonly sell consumers play and activity mats for their children's entertainment and pleasure. Such play mats usually have a colorful base, attached or removable toys and come with or without surrounding walls.

Originally these play and activity mats were provided as a source of learning and entertainment for infants. However, consumers realized that they had a short life span. Once the infant began the rolling stage, the play and activity mats became obsolete because the child could easily move off of it.

Thereafter, an inventor created a foldable playmat with removable sideguards. U.S. Pat. No. 5,035,013 to Bloom (1991) discloses a circular cushioned base with removable sideguards which follow the perimeter of the base to confine a child to a specific area; however, the removable sideguard could pose harm to an infant if the head or other body part gets wedged between the base and the removable sideguard.

Bloom's foldable infant playmat folds along the diameter wherein the base is converted into a semicircle. Continual folding could create a permanent crease in the wall portion, causing the cushioned wall to lose its shape. There is no locking mechanism for the mat in its folded position and nothing keeps the mat in its folded position while being carried and stored. When it is folded into a semicircle, it is too large and inconvenient to store in a small space without being distorted.

The foldable playmat has a 36-inch diameter with removable sideguards. This circular shape restricts the child's play area.

OBJECTS AND ADVANTAGES

Accordingly, several objects and advantages of my invention are:

(a) It provides for an open space to the corral, without all of the netting as found in most play pens, the infant/toddler can see all surroundings making him/her feel comfortable and secure.

(b) It contains water resistant nylon fabric allowing the corral to be used both indoors and outdoors (i.e. the park, beach, camping). The water resistant nylon fabric also protects against spills.

(c) It permits easy removal and insertion of the foam block walls by means of zippers sewn to the longest exterior portions of the corral for the purpose of washing.

(d) It employs a unique method of construction of the corral. Fabric pieces have been sewn to its base making it extremely sturdy when unfolded and flexible when folded. Since all fabric is attached, it provides a safe environment thus making the parent or guardian feel confident in allowing their child to play in it. When the corral is in its unfolded position, the two "U" shape pieces meet creating a perfect square.

(e) It consists of foam block walls that are thick enough so they will not lose their shape.

(f) While not in use, it folds into a rectangular shape half its original size and is secured by the locking handle and clasp mechanism. The folded corral is small enough to store in a closet, under a bed or in the trunk of a car.

Additional features and advantages will become apparent upon studying and reviewing the ensuing description and accompanying drawings.

REFERENCE NUMERALS

Figure 1:
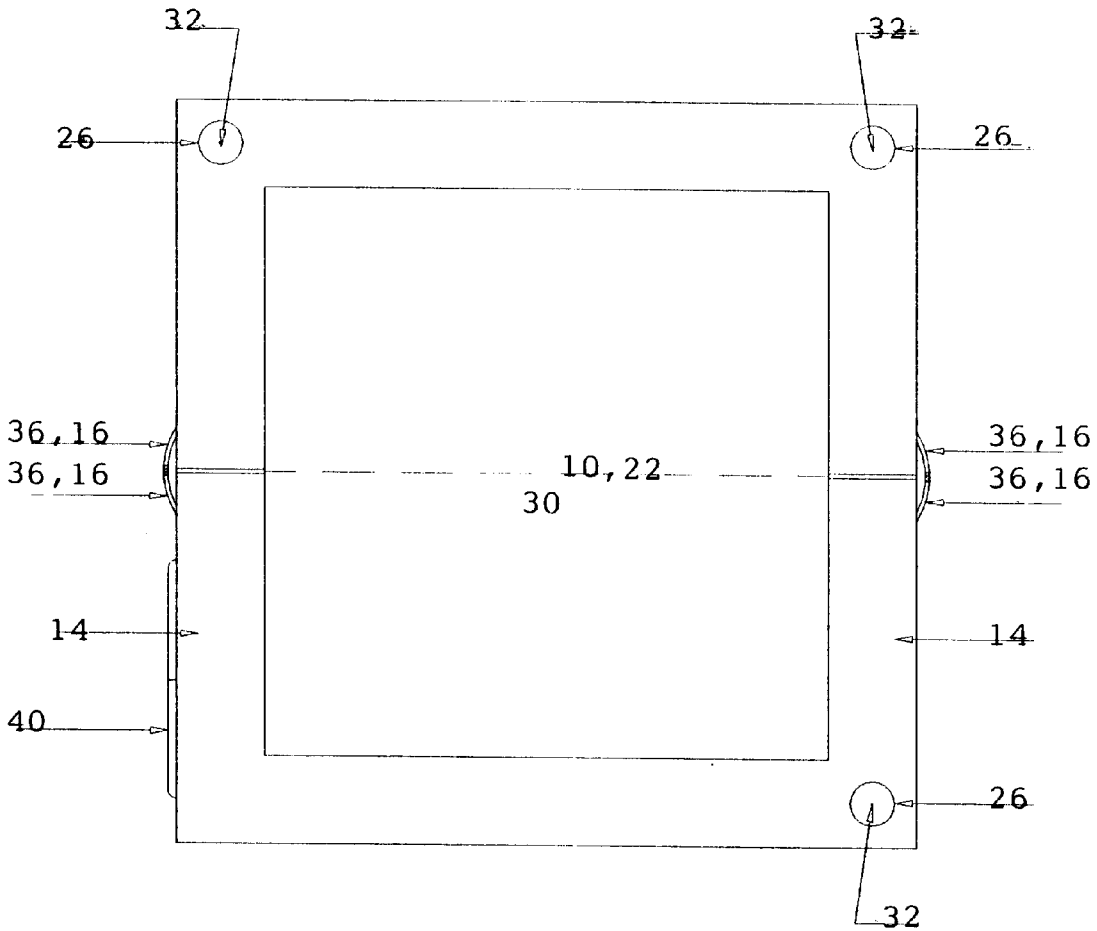
FIG. 1 is a top view of the invention showing the play mat/corral in its unfolded configuration.

10 top quilt base
14 fabric pieces
16 locking handle
18 clasp mechanism
20 zipper(s)
22 pocket
24 cylindrical cutouts
26 flex bar
28 bottom water resistant base
30 diameter
32 VELCRO strips
34 female snap
36 removable toys
38 male snap
40 foam block walls
42 elastic straps

SUMMARY

In accordance with the present invention, the infant/toddler indoor—outdoor play/mat corral with locking handle and clasp mechanism is provided with a top quilt base, a bottom water resistant base, interior, exterior and top fabric, foam block walls which follow the perimeter of the base and fold along the diameter. Securing means are provided by an overlaying foam block wall with fabric sewn to the top quilt base creating two "U" shapes that form a square. A locking handle and clasp mechanism including a handle piece sewn into one exterior wall is fitted into a clasp sewn into the opposite exterior wall forming a handle for securing and carrying purposes.

When the corral is folded along its diameter creating a single "U" shape, the foam block walls collapse and meet thus keeping the wall portions secure with the locking handle and clasp mechanism.

Water resistant nylon fabric is provided to enable the corral to be used both indoors and outdoors. Two zippers sewn into the longest exterior wall portion have been provided for easy removal and insertion of the foam block walls for washing purposes.

The foam block wall portion is large enough to confine the infant to the corral and prevents the infant from rolling out into surrounding areas. Once the infant/toddler is able to crawl, the corral converts into a playing and napping area. The foam portion is thick enough to prevent distortion in its unfolded position yet remain flexible in its folded position.

An additional embodiment allows for a removable foam flex bar with toy attachments to fasten to the cylindrical cutouts located along the top surface wall portion by means of snaps sewn to the bottom of the cutout (female snap) and to the end of the flex bar (male snap) at opposite comers when unfolded. When the corral is in its folded position, the flex bar can be secured as mentioned above into the cutouts parallel to each other, acting as a shoulder harness.

PREFERRED EMBODIMENT—DESCRIPTION

The play mat/corral is shown from the top view in its unfolded configuration in FIG. 1. Top quilt base 10 is surrounded by foam block walls 40 secured by means of fabric pieces 14 which are sewn along the top quilt base 10. A locking handle 16 and clasp mechanism 18 consisting of a handle piece 16, including a male coupling member, sewn into one exterior wall that is fitted into a clasp mechanism 18, including a female coupling member, sewn into the opposite exterior wall forming a handle for securing and carrying purposes.

Figure 2:
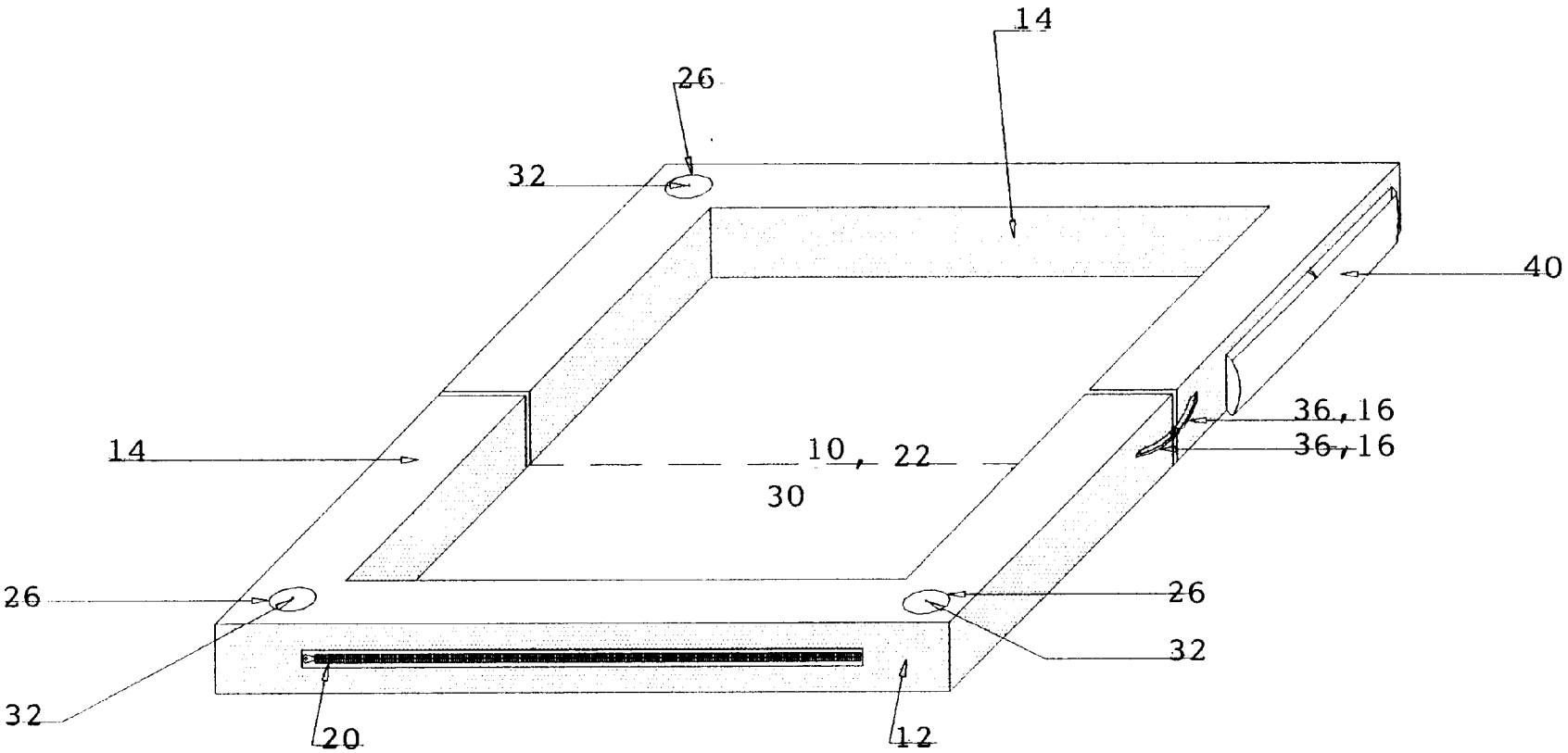
FIG. 2 is a side view of the invention showing the play mat/corral with the zipper attachment in its closed position.

The play mat/corral is shown from the side view in its unfolded configuration with the zipper 10 attachment in its closed position in FIG. 2. Two zippers 20 are sewn along the longest exterior surface wall portion opposite each other.

Figure 3:
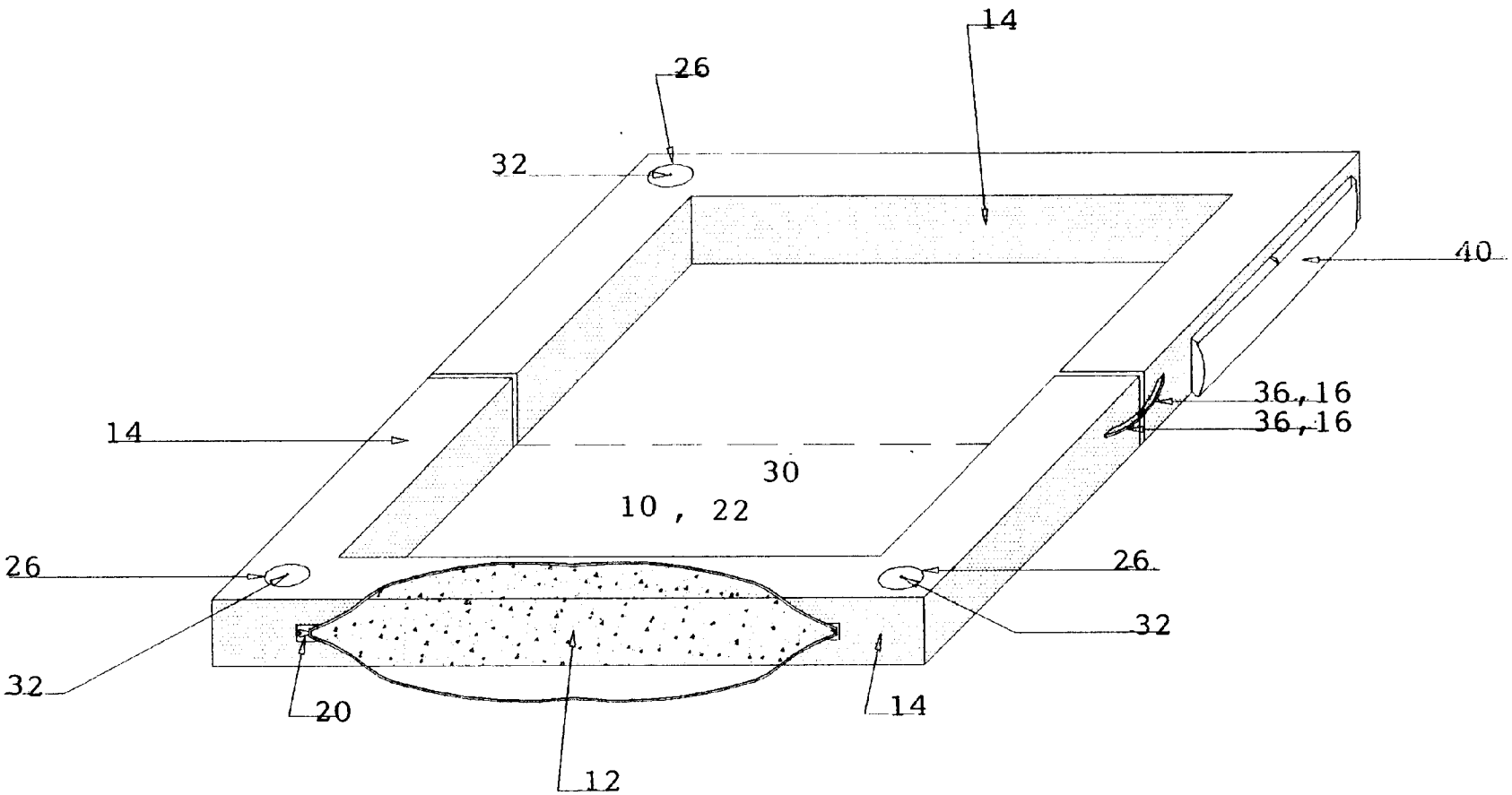
FIG. 3 is a side view of the invention showing the play mat/corral with the zipper attachment in its open position.

The play mat/corral is shown from the side view in its unfolded configuration with the zipper 20 attachment in its open position in FIG. 3. When the zipper 20 is open it is easy to remove and insert foam block walls 40 for the purpose of washing.

Figure 4A:
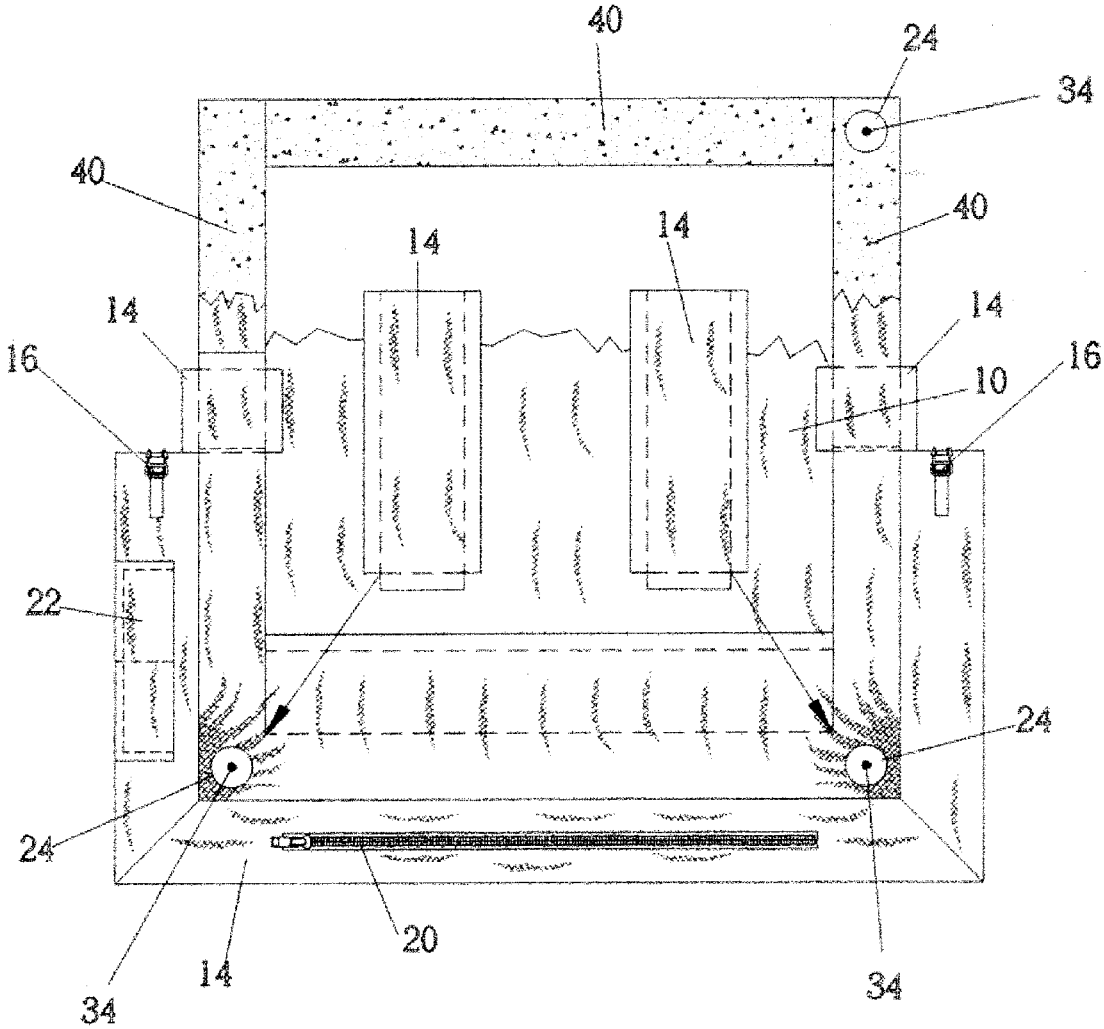
FIGS. 4*a,b* is a plan view of the invention showing the detail and applique overlaying the play/mat corral.
Figure 4B:
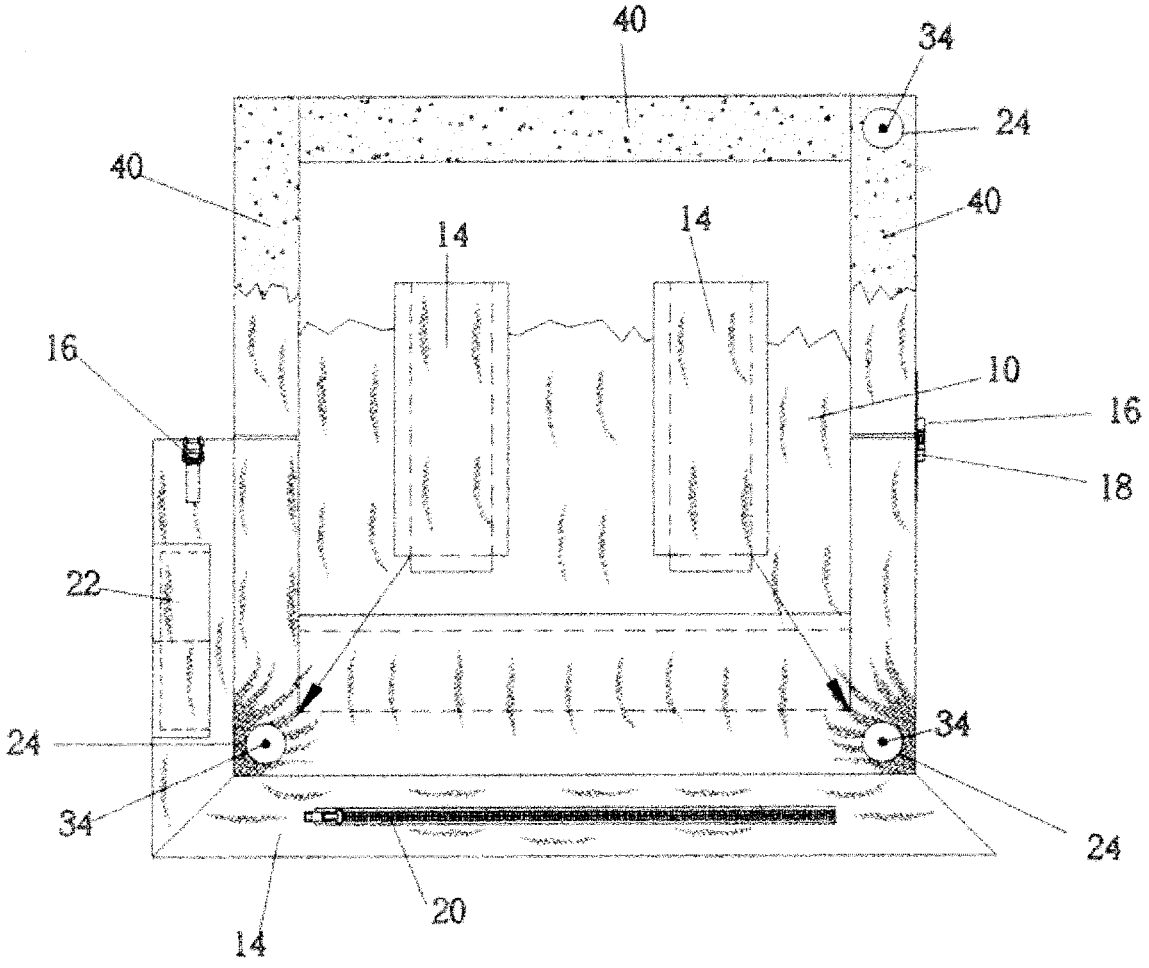

The construction of the play mat/corral is illustrated in FIGS. 4*a,b.* Foam block walls 40 follow the perimeter of the top quilt base 10. Securing means is provided by overlaying foam block walls 40 with interior, top, and exterior fabric pieces 14 which are sewn along the top quilt base 10 creating two "U" shape receiving channels forming a square. A pocket 22 is sewn along the exterior surface wall portion to provide storage of miscellaneous items. Cylindrical cutouts 24 are located along the three comers of the top surface to accommodate bottle/cups and removable flex bar 26 described in FIG. 8. Foam block walls 40 with cylindrical cutouts 24 accommodate the cylindrical cutouts 24 in the fabric.

The bottom water resistant base 28 and the top quilt base 10 have a diameter 30 of 42 inches and a height of 1 to 1½ inches. The foam block walls 40 are 4 inches in height and 5 inches in width. The top quilt base 10 is soft enough for napping while the foam block walls 40 create a safe and stable environment for the infant/toddler.

Figure 5:
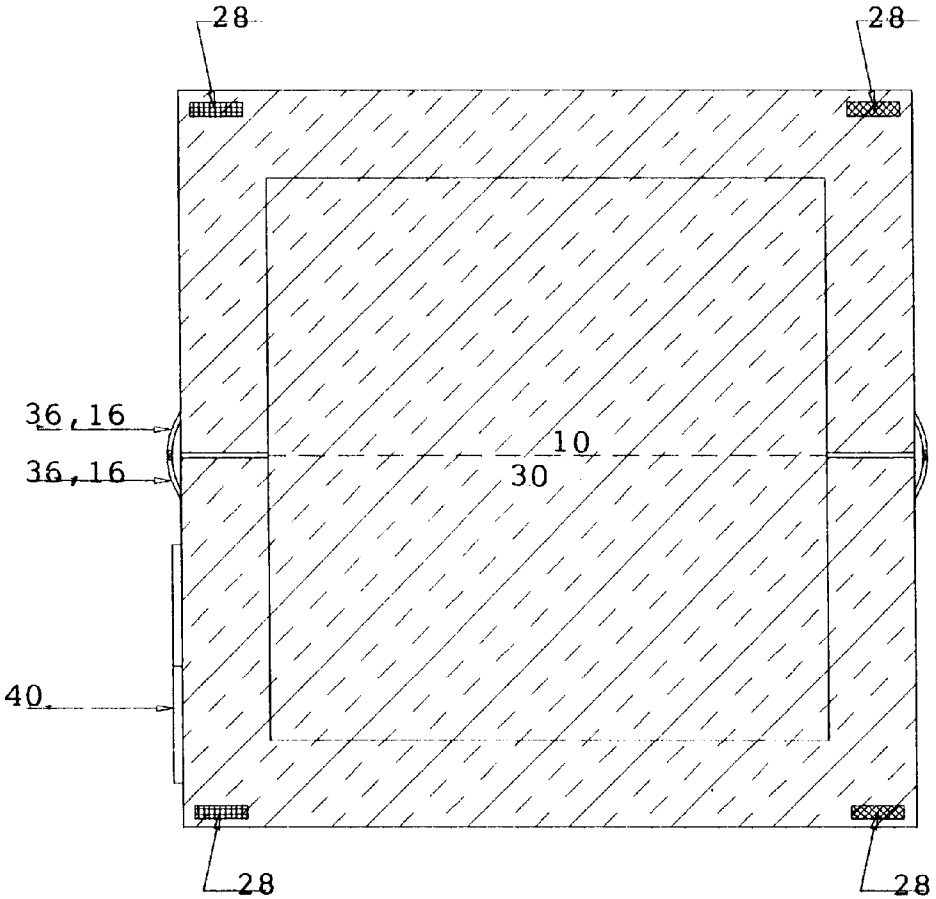
FIG. 5 is a back view of the invention showing the bottom water resistant base of the play mat/corral with hook and pile strips for securing purposes.

The play/mat corral is shown from the back view of its unfolded configuration in FIG. 5. Bottom water resistant base 28 has four VELCRO strips 32 which are sewn along each corner of the play mat/corral. VELCRO is a trademark for "hook and pile" cloth registered to VELCRO USA. When the play mat/corral is folded along the diameter 30 VELCRO strips 32 on one side of the bottom water resistant base 28 fasten to strips on the opposite side allowing the play mat/corral foam block walls 40 to collapse without the bottom water resistant base 28 opening.

Figure 6A:
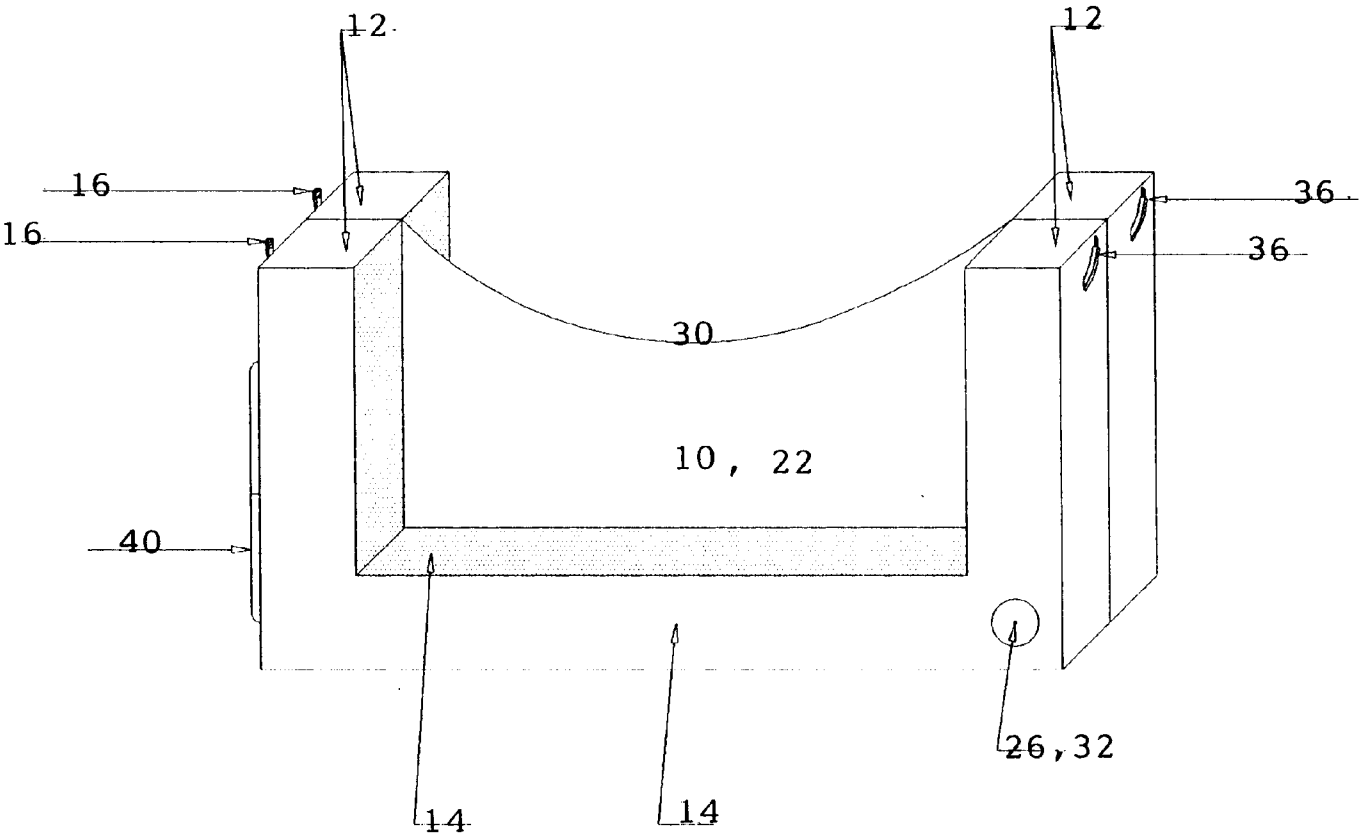
FIGS. 6*a,b* is a side view of the invention showing the play mat/corral in its folded position with locking handle and clasp mechanism.
Figure 6B:
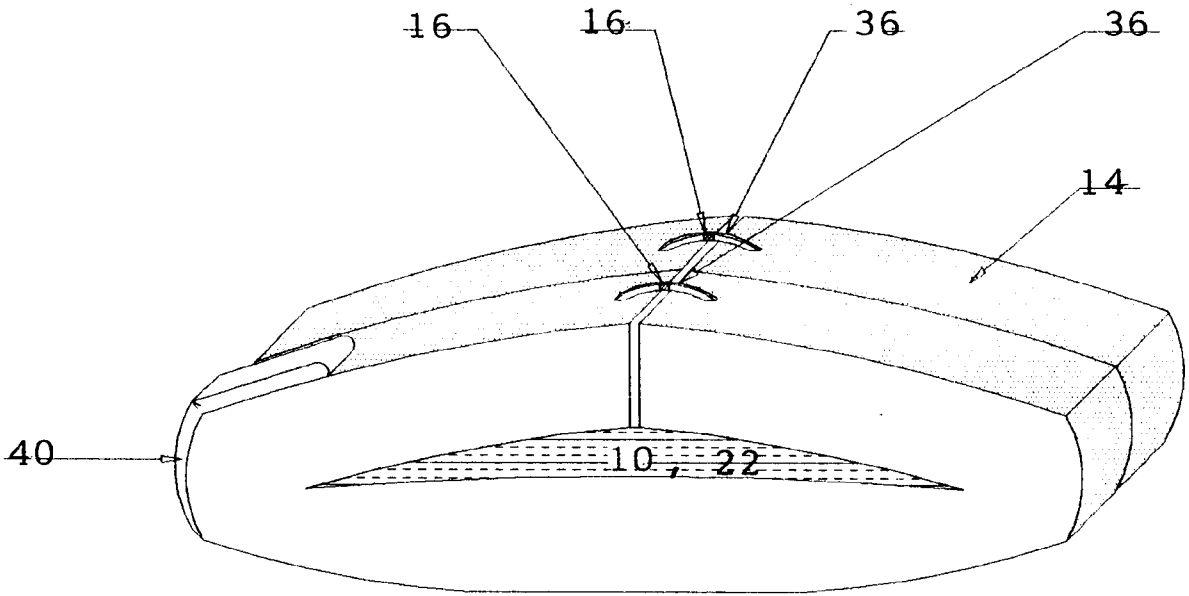

The play mat/corral is shown from a side view of its folded configuration shown in FIGS. 6*a.b.* When the play mat/corral is folded along the diameter 30 creating a single "U" shape, the foam block walls 40 collapse and meet as aforementioned in FIG. 5., thus keeping the foam block wall 40 portions secure with the locking handle 16 and clasp mechanism 18.

Figure 7:
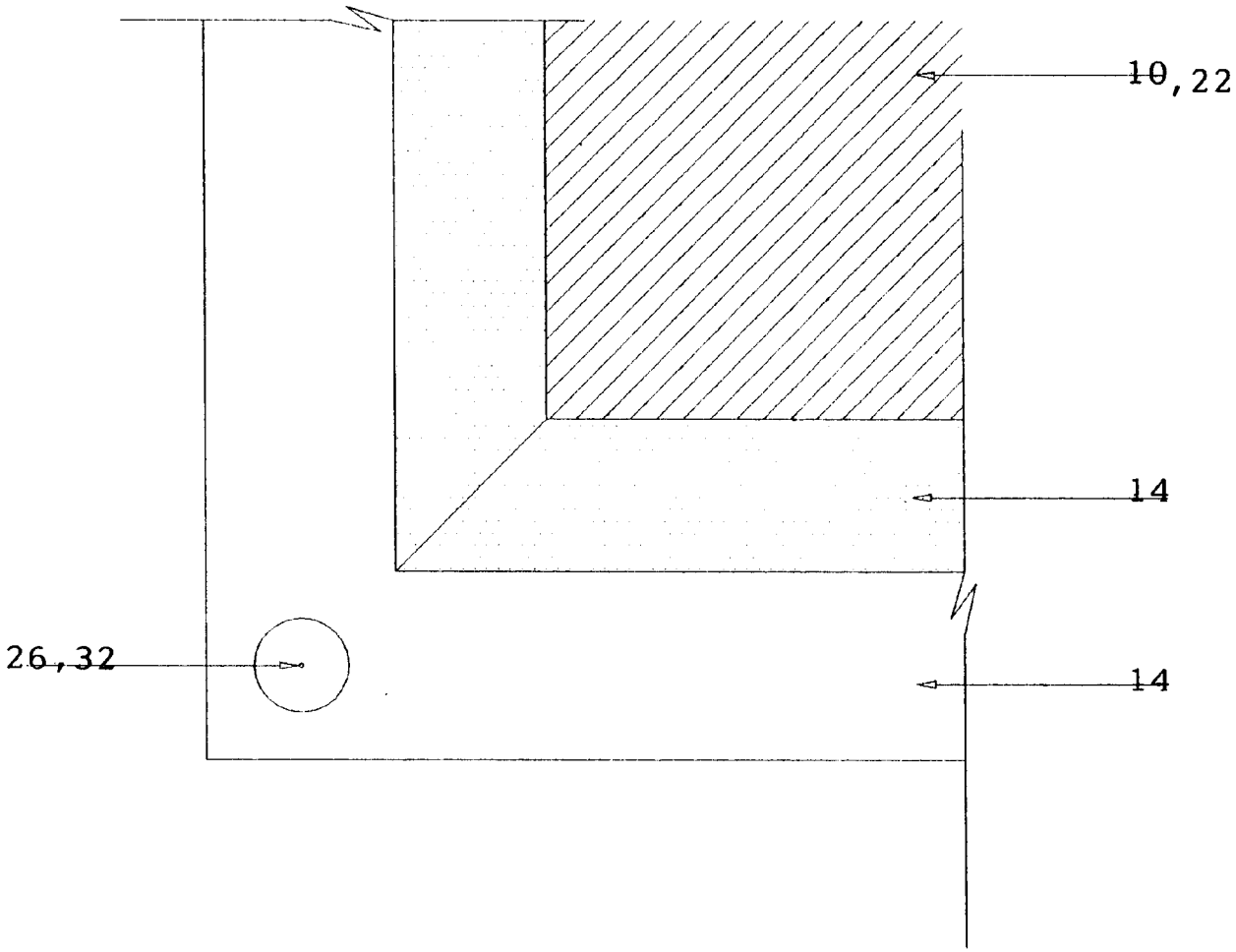
FIG. 7 is a sectional view of the top surface portion with cylindrical cutouts to accommodate bottle/cups and the flex bar with removable toys.

The play/mat corral is shown from an exploded corner view of its unfolded configuration with cylindrical cutouts 24 in FIG. 7. Cylindrical cutouts 24 are 2½ inches in diameter and 3 inches in height. A female snap 34 has been sewn along the bottom portion of the cutout 24 for the use of flex bar 26 which is described as the alternative embodiment in FIG. 8.

Figure 8:
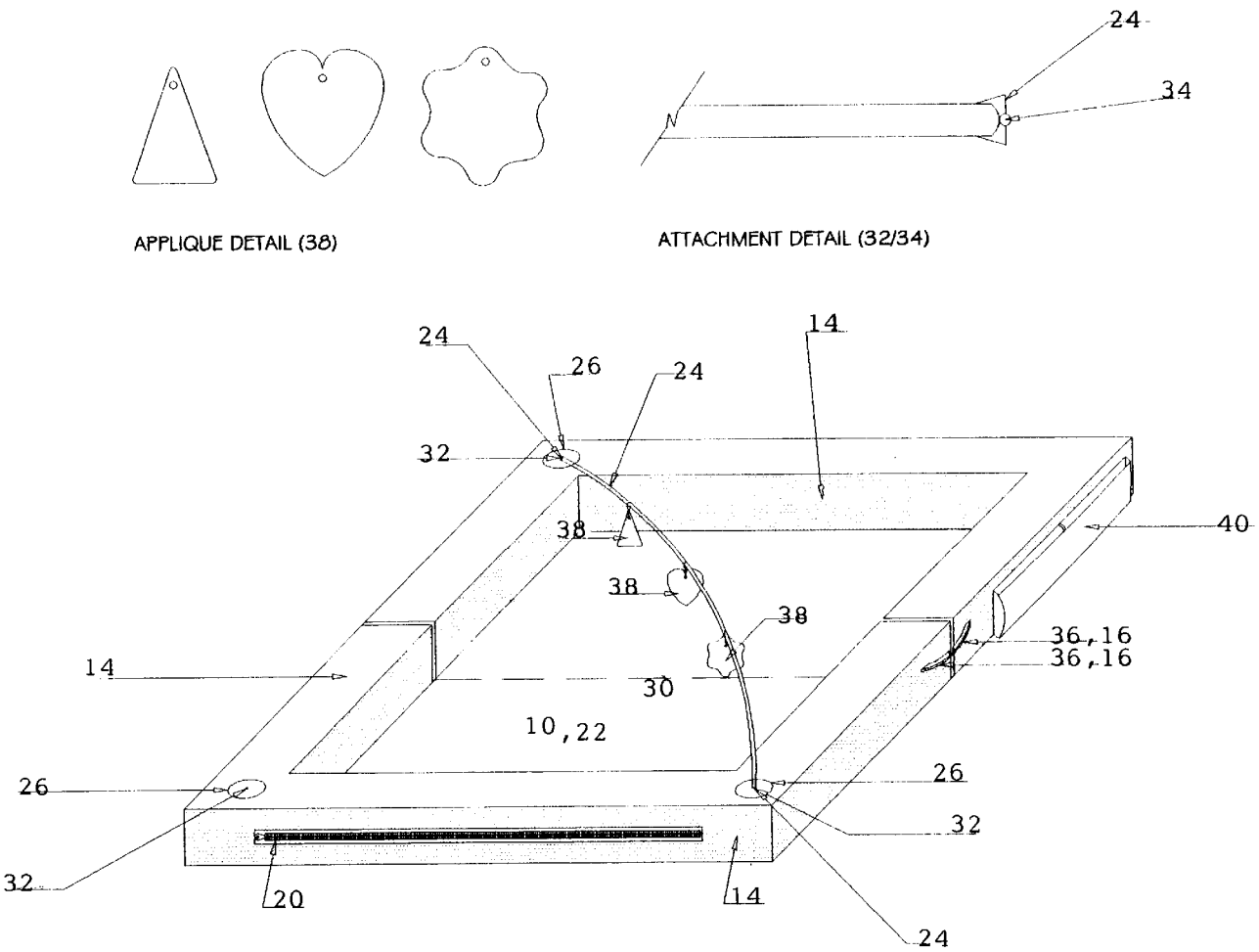
FIG. 8 is a side view of an alternative embodiment of the present invention with additional features.

The play/mat corral is shown from the side view as an alternative embodiment in FIG. 8. Flex bar 26 providing a male snap 38 sewn along its end surface(s) fasten to female snaps 34 sewn along the bottom surface(s) of the cylindrical cutouts 24 to accommodate the bottle/cup and flex bar 26 which provide entertainment for the infant/toddler when unfolded and as a shoulder harness when folded. The flex bar 26 has removable toys 36 attached to elastic straps 42 which loop around the bar prior to fastening. Toys 36 can be removed and stored in the side pocket 22 when flex bar 26 is being used as a shoulder strap.

OTHER EMBODIMENTS

Flex bar with toy attachments—Description

As an alternative embodiment the cylindrical cutouts 24 in the fabric to accommodate bottle/cup may also accommodate the flex bar 26 as shown in FIG. 8. The flex bar 26 has a male snap 38 which is sewn to the bottom portion of the flex bar 26. The male snap 38 will fasten to the female snap 34 which is sewn to the bottom portion of the cylindrical cutout 24 in the fabric to accommodate the flex bar 26. The opposite end of the flex bar 26 is fastened in the same manner aforementioned. Removable toys 36 attached to elastic straps 42 are looped around the flex bar 26 prior to fastening the snaps to the cylindrical cutouts 24. The flex bar 26 with removable toys 36 will act as entertainment for the infant/toddler in its unfolded configuration and as a shoulder harness in its folded configuration.

CONCLUSIONS, RAMIFICATIONS, AND SCOPE

Accordingly, the reader will see that the infant/toddler play/mat corral with the locking handle and clasp mechanism can be folded and unfolded easily, secured in place while folded for easy storage, carried with the ease of one-hand freeing up the-other, and is safe due to the fact that the handle and clasp mechanism is attached to the unit and does not have any straps that can fit around a child's neck. Furthermore, the infant/toddler indoor—outdoor play/mat corral with locking handle and clasp mechanism has the additional advantages in that:

It provides water resistant nylon fabric allowing the corral to be used both indoors and outdoors;

It provides foam block walls that are thick enough so they will not lose their shape over time;

It provides safety for the infant/toddler as fabric is sewn into the base creating a sturdy environment;

It provides for maximum space utilization for the individual child or for several children when the units are placed side by side;

It provides for an open atmosphere design allowing the child to have full view of his/her surroundings;

Although the description above contains many specifications, these should not be construed as limiting the scope of the invention but as merely providing illustrations of some of the presently preferred embodiments of this invention. Various other embodiments and ramifications are possible within it's scope. For example, adding a foam flex bar with toy attachments. This can be used as entertainment for the infant/toddler.

Thus the scope of the invention should be determined by the appended claims and their legal equivalents, rather than by the examples given.

What is claimed is:

1. An infant/toddler, indoor/outdoor playmat comprising:

a substantially rectangular, cushioned base having a perimeter and a bottom surface;

foam block walls disposed on and along the perimeter;

fabric pieces sewn along said base thus creating two U-shaped receiving channels;

the U-shaped receiving channels having a top wall, a bottom wall, outer walls and inner walls defining a play area;

the U-shaped receiving channels each having one base wall and two side leg walls, the two base walls, of the respective U-shaped receiving channels, being disposed opposite one another and each having an opening to allow removal/insertion of the foam block walls into said channel;

a fold line defined by two adjoining pairs of side leg walls of the "U" shaped receiving channels and extending along a middle of the rectangular base;

a locking handle and clasp mechanism comprising a strap having a male coupling member and a strap having a female coupling member, the mechanism being disposed at the fold line on a portion of the outer wall of each of the side leg walls wherein the male member strap is disposed on one side of the fold line and the female member strap is disposed on the opposite side of the fold line, the male member strap on each of the side leg walls being opposite the female member strap on the opposing side leg wall;

the male and female member straps of each mechanism being attached in an unfolded configuration of the playmat and being unattached in a first folded configuration of the playmat to allow for folding of the playmat;

the bottom surface of the base having fasteners;

wherein in the first folded configuration the playmat folds outwardly along the fold line to expose the play area, the playmat being held in said first folded configuration by said fasteners on the bottom surface;

wherein while in the first folded configuration, each pair of side leg walls is capable of being folded such that the male member strap on each side leg wall couples with the opposite female member strap on the opposing side leg wall to attain a second folded configuration which is compact and allows the playmat to be easily stowed;

wherein the coupled straps of the second folded configuration are arranged in a position suitable for use as handles for carrying the playmat.

2. The infant/toddler, indoor/outdoor playmat of claim 1, wherein in the unfolded configuration the foam block walls are all of equal height, width and length.

3. The infant/toddler, indoor/outdoor playmat of claim 1, wherein the foam block walls are sturdy and thick enough that the playmat will not lose its shape over time, yet are soft enough to provide a safe and comfortable environment for the child.

4. The infant/toddler indoor/outdoor playmat of claim 1, wherein the foam block walls act as a security wall to keep the child from wandering away.

5. The infant/toddler indoor/outdoor playmat of claim 1, wherein the foam block walls are removable to allow for machine washing of the playmat.

6. The infant/toddler, indoor/outdoor playmat of claim 1, wherein at one or more of the four corners of the base a cylindrical cutout is formed in the top wall of the U-shaped receiving channels.

7. The infant/toddler, indoor/outdoor playmat of claim 6, wherein the cylindrical cutouts may accommodate a bottle/cup and a foam flex bar with removable toy attachments.

8. The infant/toddler, indoor/outdoor playmat of claim 1, wherein the playmat comprises a water resistant nylon fabric.

9. The infant/toddler, indoor/outdoor playmat of claim 8, wherein the water resistant nylon fabric can be used for indoor and outdoor use.

10. The infant/toddler, indoor/outdoor playmat of claim 1, wherein the base is square when unfolded.

11. The infant/toddler, indoor/outdoor playmat of claim 1, wherein said fasteners on the bottom surface comprise hook and pile type fasteners.

12. The infant/toddler, indoor/outdoor playmat of claim 1, wherein said openings on the two base walls comprise zippered openings.

* * * * *